US010203104B2

(12) United States Patent
Qian

(10) Patent No.: US 10,203,104 B2
(45) Date of Patent: Feb. 12, 2019

(54) LED LAMP

(71) Applicant: HANGZHOU ANDER ELECTRON CO., LTD., Hangzhou (CN)

(72) Inventor: Wenhu Qian, Hangzhou (CN)

(73) Assignee: HANGZHOU ANDER ELECTRON CO., LTD., Hangzhou (CN)

( * ) Notice: Subject to any disclaimer, the term of this patent is extended or adjusted under 35 U.S.C. 154(b) by 0 days.

(21) Appl. No.: 15/646,125

(22) Filed: Jul. 11, 2017

(65) Prior Publication Data

US 2018/0283678 A1 Oct. 4, 2018

(30) Foreign Application Priority Data

Apr. 1, 2017 (CN) ..... 2017 2 0345488 U
Jun. 8, 2017 (CN) ..... 2017 2 0663415 U
Jun. 8, 2017 (CN) ..... 2017 2 0663703 U
Jun. 8, 2017 (CN) ..... 2017 2 0663851 U

(51) Int. Cl.

| | |
|---|---|
| ***F21V 11/00*** | (2015.01) |
| ***F21V 29/83*** | (2015.01) |
| ***F21V 3/06*** | (2018.01) |
| ***F21V 15/01*** | (2006.01) |
| ***F21V 17/12*** | (2006.01) |
| ***F21V 21/02*** | (2006.01) |
| ***F21V 23/00*** | (2015.01) |
| *F21Y 105/18* | (2016.01) |
| *F21Y 115/10* | (2016.01) |
| *F21Y 105/00* | (2016.01) |

(52) U.S. Cl.

CPC ..... *F21V 29/83* (2015.01); *F21V 3/062* (2018.02); *F21V 15/01* (2013.01); *F21V 17/12* (2013.01); *F21V 21/02* (2013.01); *F21V 23/001* (2013.01); *F21Y 2105/00* (2013.01); *F21Y 2105/18* (2016.08); *F21Y 2115/10* (2016.08)

(58) Field of Classification Search

CPC ..... F21V 29/83; F21V 3/062; F21V 21/02; F21V 15/01; F21V 23/001; F21V 17/12; F21Y 2105/18; F21Y 2115/10

See application file for complete search history.

(56) References Cited

U.S. PATENT DOCUMENTS 4,064,868 A * 12/1977 Nussbaum ..... F24S 40/70 126/588
7,988,335 B2 * 8/2011 Liu ..... F21S 8/04 362/294

(Continued)

FOREIGN PATENT DOCUMENTS

EP 2927575 A1 10/2015

*Primary Examiner* — Ali Alavi
(74) *Attorney, Agent, or Firm* — Mark M. Friedman

(57) ABSTRACT

The present invention provides an LED lamp comprising a lamp housing, a lamp cover and a light source plate, the lamp cover is located at one end of the lamp housing, and the other end of the lamp housing is provided with an opening, the light source plate comprises an insulating plate and lamp beads provided on the insulating plate. The insulating plate is connected with the lamp housing, and the insulating plate encloses the opening; the original aluminum plate is replaced by the insulating plate, while the insulating plate is directly connected with the lamp housing, the heat produced by the lamp beads is directly dissipated through the insulating plate and the lamp housing.

9 Claims, 7 Drawing Sheets

(56) References Cited

U.S. PATENT DOCUMENTS

| | | | | |
|---|---|---|---|---|
| 8,240,875 | B2 * | 8/2012 | Roberts | F21V 5/002 362/217.05 |
| 2010/0225215 | A1 * | 9/2010 | Lee | F21K 9/00 313/1 |
| 2015/0103528 | A1 | 4/2015 | Seki | |
| 2015/0123559 | A1 | 5/2015 | Kim et al. | |
| 2015/0332982 | A1 * | 11/2015 | Ono | H01L 23/296 257/676 |

* cited by examiner

A-A

LED LAMP

TECHNICAL FIELD

The present invention relates to the field of illumination, and more particularly to an LED lamp.

BACKGROUND ART

At present, with the development of science and technology, LED light source is considered the fourth generation of illumination source, LED bar lamps have been widely used in a variety of illumination fields because of high luminous efficiency, low power consumption and high security.

An LED lamp for breeding, with the Publication No. CN204358477U, comprises a lamp cap, a lamp housing and a lamp cover, the lamp housing is composed of an inner aluminum layer and an outer heat-resistant plastic layer.

Although the inner aluminum layer is rapid in heat dissipation, its overall heat dissipation effect is still undesirable due to the fact that the lamp housing also has an outer heat-resistant plastic layer, while the outer heat-resistant plastic layer has a poor heat dissipation effect.

SUMMARY OF THE INVENTION

It is an object of the present invention to provide an LED lamp having a good heat dissipation effect and a low cost.

The above-mentioned technical object of the invention is achieved by the following technical solution: an LED lamp comprising a lamp housing, a lamp cover and a light source plate, the lamp cover is located at one end of the lamp housing, and the other end of the lamp housing is provided with an opening, the light source plate comprises an insulating plate and lamp beads provided on the insulating plate. The insulating plate is connected with the lamp housing, and the insulating plate encloses the opening.

The original aluminum plate is replaced by the insulating plate, while the insulating plate is directly connected with the lamp housing, the heat produced by the lamp beads is directly dissipated through the insulating plate and the lamp housing. The heat dissipation effect is better, back of the light source plate (a side of the lamp bead is not provided) is directly exposed to heat, to further enhance its heat dissipation effect to be better, at the same time, the lamp housing structure composed of the original inner aluminum layer and the outer heat-resistant plastic layer is discarded, and the light source plate is taken as part of the lamp housing, which effectively reduces the costs of producing the LED lamps.

Further, the insulating plate is a bakelite plate or a fiberglass plate.

Further, the insulating plate is covered with a copper layer on one side far from the lamp beads.

The copper layer is a layer of copper plated on the insulating plate, which can be provided to enhance the rigidity of the insulating plate to reduce the aging thereof, and is especially for outdoor lamps mounted.

Further, a first card slot and a second card slot are provided in the lamp housing, the insulating plate is clamped with the first card slot, and the lamp cover is connected to the second card slot.

As such, it is convenient to rapidly mount the LED lamps.

Further, a first restriction piece and a second restriction piece are provided in the inner wall of the lamp housing, the first restriction piece and the second restriction piece are spaced apart, the second restriction piece is provided thereon with an opening, a side of the insulating plate is fixed thereon with a restriction portion that is smaller or equal to the opening, the restriction portion is abutted against the first restriction piece and the second restriction piece respectively after the restriction portion of the light source plate is brought into rotation from the opening.

In a manner of rotating to clamp, the restriction portion is abutted against the first restriction piece and the second restriction piece respectively after the restriction portion is brought into rotation from the opening, and the light source plate is restricted by the first restriction piece and the second restriction piece, thus not easily falling off; while the adhesive is not used, and the cost is lower. The restriction piece is not just in form of a piece, but a block, etc., as long as it can play the role of restriction.

Further, the light source plate is provided thereon with a card slot, and the inner wall of the lamp housing is provided with a card in cooperation with the card slot.

The card slot and the card are provided, such that the light source plate is less prone to circumferential rotation, further enhancing the connection reliability of the light source plate and the lamp housing.

The light source plate further comprises a connection point fixed on the insulating plate, a wire connected with the connection point and passing out of the lamp housing, the lamp housing is provided thereon with a mounting hole for the wire entering the inner cavity of the lamp housing, and the wire is bent at least twice during entering from the mounting hole to the path connected with the connection point.

Further, the mounting hole comprises a first passage extending circumferentially along the lamp housing, a second passage axially extending along the lamp housing to be communicated therewith, and a folded-over passage communicated with the second passage and extending circumferentially along the lamp housing; the first passage, the second passage and the folded-over passage are connected successively, and the folded-over passage is opposite to the extending direction of the first passage; an outlet and the connection point of the folded-over passage are spaced in the circumferential direction of the lamp housing.

The bending of the wire is due to the bending of the mounting hole. Through the above design, the wire is bent several times to enhance the friction between the wire and the mounting hole, so that the wire is not easily disengaged from the connection point; the structure is simple and the cost is low.

Further, a mounting assembly for mounting the LED lamp is included, the mounting assembly comprises a metal connection piece inserted outside the lamp housing, a screw nut piece inserted inside the lamp housing, and a bolt passing through the metal connection piece and the lamp housing and screwed to the nut piece.

The bolt is directly connected with the lamp housing and would easily fall off due to aging of plastics; the screw is connected with the nut piece through the lamp housing, the connection strength is high, and thus damage is not easily caused; at the same time, the nut piece is provided to reduce the stress concentration and the probability of damage to the lamp housing.

Further, the lamp housing is further provided thereon with a protective cover located at the other end of the light source plate, and the protective cover is provided thereon with a heat dissipation hole.

As the protective cover is provided, the dripping will not fall directly onto the light source plate, the heat dissipation hole on the protective cover is provided to lower the surface temperature of the protective cover, the dripping will not easily burn after being dropped on the protective cover, which greatly enhances its safety; and because of this, the power of the LED lamp can also be relatively increased.

In view of the above, the invention has the following beneficial effects: 1) the original aluminum plate is replaced by the insulating plate, while the insulating plate is directly connected with the lamp housing, the heat produced by the lamp beads is directly dissipated through the insulating plate and the lamp housing, and the heat dissipation effect is better, back of the light source plate (a side of the lamp bead is not provided) is directly exposed to heat, to further enhance its heat dissipation effect to be better; 2) the metal connection piece and the nut piece are provided, the strength is high, and thus damage is not easily caused; 3) the way the light source plate and the lamp housing are connected is changed from bonding to rotating to clamp, so as to enhance the light source plate and lamp housing connection reliability, and enhance the quality of LED lamps; 4) the internally bent mounting hole is provided to enhance the connection strength between the wire and the connection point; 5) the overall safety of the LED lamps is improved by providing the protective cover, 6) the lamp housing structure composed of the original inner aluminum layer and the outer heat-resistant plastic layer is discarded, and the light source plate is taken as part of the lamp housing, which effectively reduces the costs of producing the LED lamps.

Reference numbers: 1. lamp housing; 11. card; 12. guide slope; 13. the first card slot; 14. the second card slot; 15. the first slot; 16. the second slot; 17. ring slot; 18. coupling slot; 19. opening; 2. light source plate; 21. insulating plate; 211. card slot; 212. guide notch; 22. lamp bead; 23. restriction portion; 24. connection point; 3. lamp cover; 4. protective cover; 41. heat dissipation hole; 5. mounting hole; 51. the first passage; 52. the second passage; 53. mounting ramp; 54. guide piece; 55. folded-over passage; 61. the first restriction piece; 62. the second restriction piece; 621. opening; 622. mounting portion; 623. oblique angle; 71. metal connection piece; 72. nut piece; 73. bolt; 8. lamp frame; 9. light-transmitting plate;

DETAILED DESCRIPTION OF THE INVENTION

The invention will now be described in further detail with reference to the accompanying drawings.

The present embodiment is merely illustrative of the present invention and is not intended to be limiting of the present invention. Those skilled in the art will be able to make an unintended contribution to the present embodiment upon reading the description, but the embodiment is protected by patent law as long as it is within the protection scope of the present invention.

The LED lamp can be bar lamps, panel lamps, torch lamps, street lamps and so on.

Figure 1:
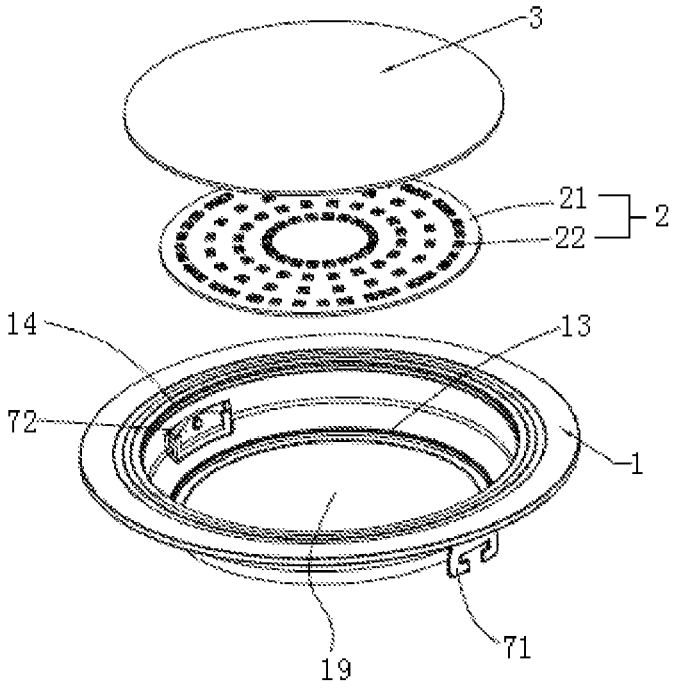
FIG. 1 is a schematic view showing the exploded structure of Embodiment 1.

Embodiment 1 introduced by the present embodiment is a torch lamp as shown in FIG. 1, which comprises a lamp housing made from plastic with an opening 19 on either end thereof, a lamp cover 3 made from plastic, and a light source plate 2. The lamp housing 1 is provided therein with a first card slot 13 and a second card slot 14 which are both annular card slots. The light source plate 2 comprises an insulating plate 21 and a lamp bead provided on the insulating plate 21, and the insulating plate 21 is clamped into the first card slot to enclose one of the openings 19 in the lamp housing 13; the lamp cover 3 is a transparent circular piece which is clamped into the second card slot 14 to enclose the other opening. In this embodiment, the insulating plate 21 is a bakelite plate or a fiberglass plate.

Figure 2:
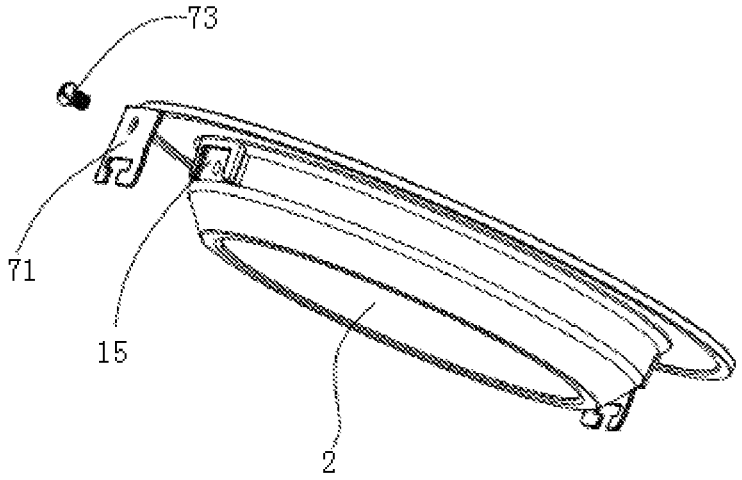
FIG. 2 is a schematic view showing an exploded structure of a first slot and a metal connection piece.
Figure 3:
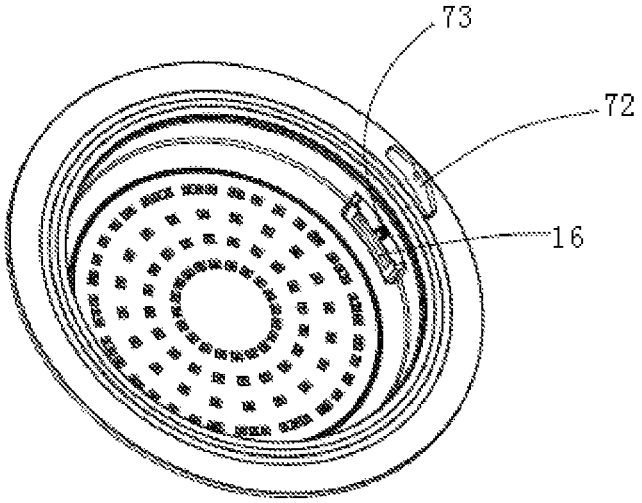
FIG. 3 is a schematic view showing an exploded structure of a second slot and a nut piece.

As shown in FIGS. 2-3, two symmetrical metal connection pieces 71 are provided on the outside of the lamp housing 1 for mounting the LED lamp, and the metal connection piece 71 is a steel sheet. The first slot 15 is provided on the outside of the lamp housing 1, the second slot 16 is provided at the position opposite to the first slot 15, and one end of the metal connection piece 71 is inserted into the first slot 15, the nut piece 72 is inserted into the second slot 16, the bolt 73 passes through the metal connection piece 71, the lamp housing 1 to be connected to the nut piece 72.

Embodiment 2 a torch lamp is different from Embodiment 1 in that the insulating plate 21 is covered with a copper layer at a side deviating from the lamp bead 22 (not shown in the Fig.). The copper layer is a layer of copper plated on the insulating plate 21, which can be provided to enhance the rigidity of the insulating plate 21 to reduce the aging thereof, and is especially for the outdoor lamps mounted.

Figure 4:
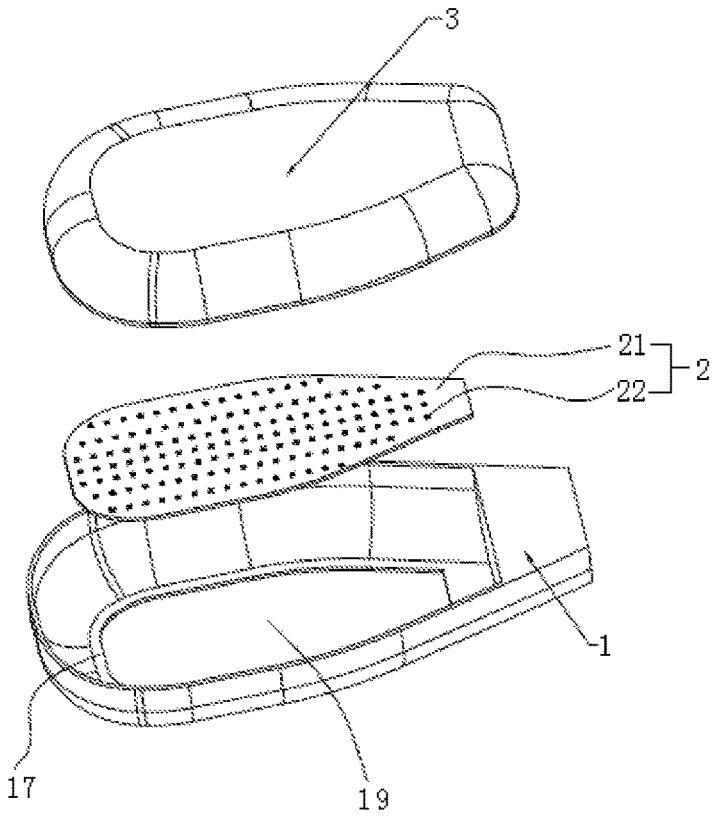
FIG. 4 is a schematic view showing the exploded structure of Embodiment 3.

Embodiment 3 a street lamp, as shown in FIG. 4, comprises a lamp housing 1 having an opening 19 on either end, and a ring slot 17 is formed in the lamp housing 1. The light source plate 2 comprises an insulating plate 21 and lamp beads 22 fixed to one side of the insulating plate 21, and the other side of the insulating plate 21 is covered with a copper layer. The insulating plate 21 is fixed in the ring slot 17, and the lamp cover 3 is covered on the lamp housing 1. In this embodiment, the insulating plate 21 is a bakelite plate or a fiberglass plate.

Figure 5:
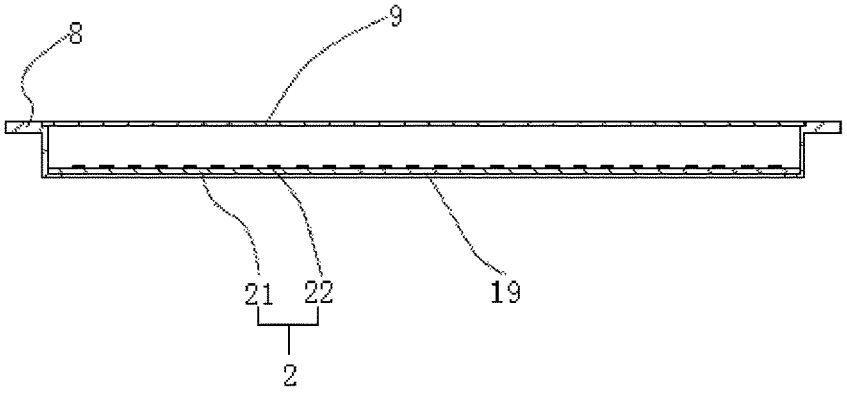
FIG. 5 is a schematic view showing the section view of Embodiment 4.

Embodiment 4 a panel lamp, as shown in FIG. 5, comprises a light frame 8 having an opening 19 on either side, and a light source plate 2 fixed in the lamp frame 8. The light source plate 2 comprises an insulating plate 21 and lamp beads 22 fixed to one side of the insulating plate 21. The light-transmitting plate 9 is located outside the lamp bead 22 and is fixed to the lamp frame 8. In this embodiment, the insulating plate 21 is a bakelite plate or a fiberglass plate.

Figure 6:
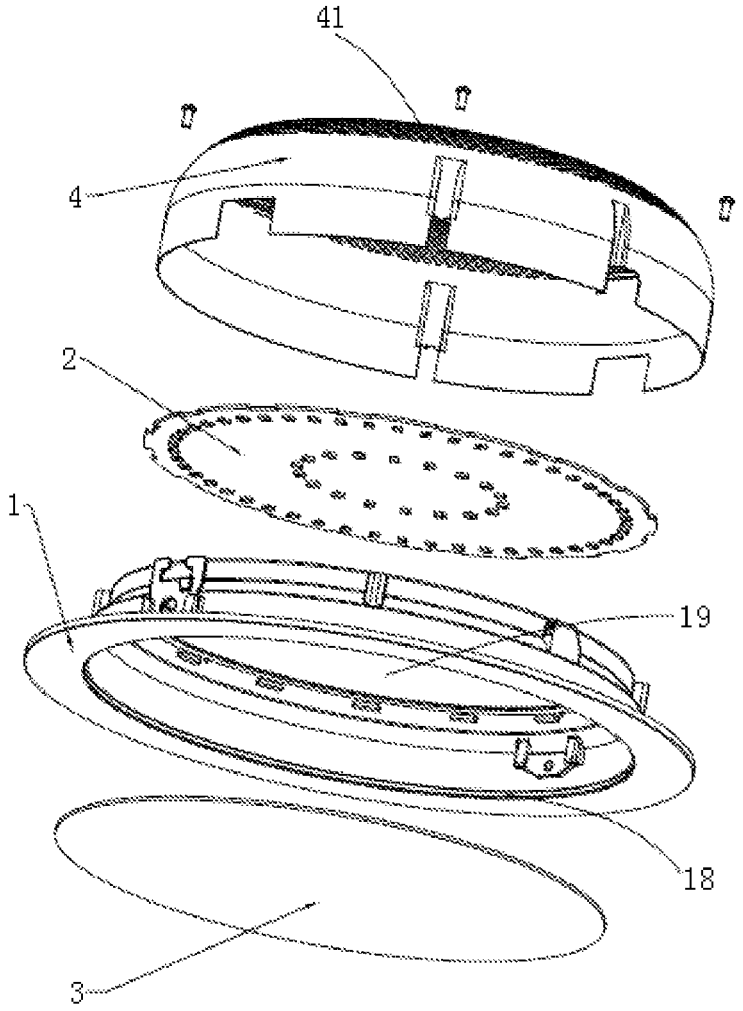
FIG. 6 is a schematic view showing the exploded structure of Embodiment 5.

Embodiment 5 a torch lamp, as shown in FIG. 6, comprises a disc-shaped lamp housing 1 having an opening 19 on either end, a light source plate 2 fixed onto the lamp housing 1, and a lamp cover 3 fixed onto the lamp housing 1 on either end of the light source plate 2, and a protective cover 4.

Figure 7:
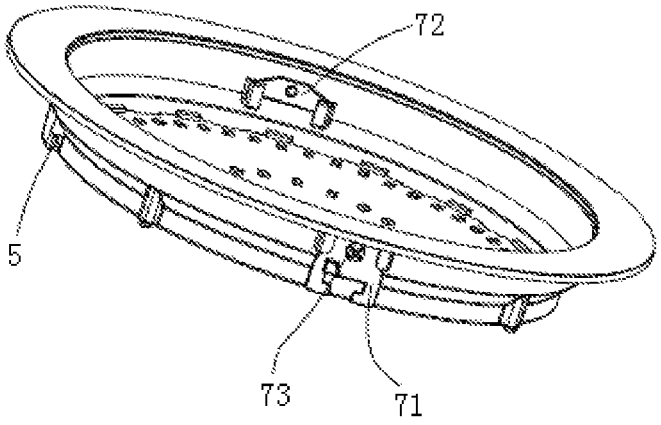
FIG. 7 is a schematic view showing the connection structure of the lamp housing and the light source plate of Embodiment 5.
Figure 8:
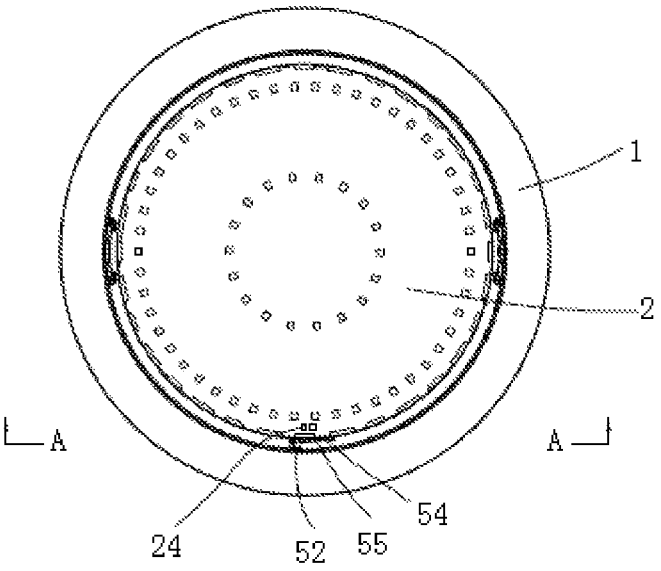
FIG. 8 is a top view of FIG. 7.
Figure 9:
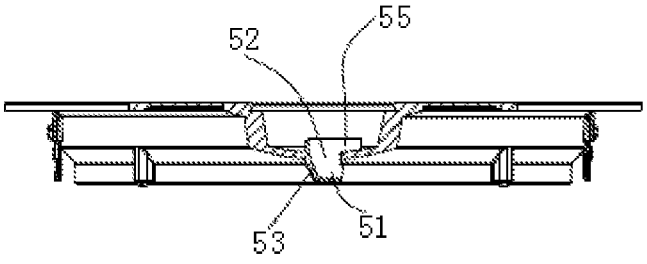
FIG. 9 is a cross-sectional view of FIG. 8.

As shown in FIG. 7, the center of the lamp housing 1 is passed through, and a mounting hole 5 is formed on the outer wall of the lamp housing 1. As shown in FIG. 9, the mounting hole 5 comprises a first passage 51 extending circumferentially along the lamp housing 1, a second passage 52 axially extending along the lamp housing 1 to be communicated with the inner cavity of the lamp housing 1, and one end of the first passage 51 is communicated externally with the lamp housing 1, and the other end thereof is communicated with the second passage 52, and the second passage 52 has a mounting slope 53 which facilitates the extension of the wire; as shown in FIG. 5, a guide piece 54 is fixed onto the inner wall of the lamp housing 1, and the guide piece 54 is spaced from the inner wall of the lamp housing 1 to form a folded-over passage 55 which extends circumferentially along the lamp housing 1, and extends in a direction opposite to that of the first passage 51.

The lamp housing 1 is fixed with a first mount for mounting the light source plate 2 at one end thereof, and the other end of the lamp housing 1 is fixed with a second mount for mounting the lamp cover 3.

Figure 10:
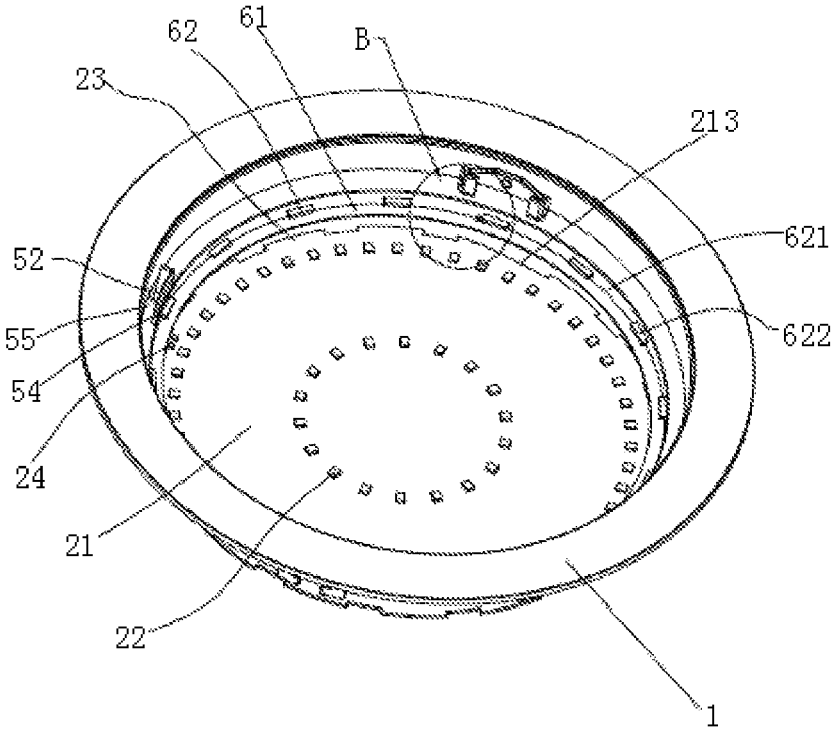
FIG. 10 is a schematic view showing the exploded structure of the lamp housing and the light source plate of Embodiment 5.

As shown in FIG. 10, the first mount includes an annular first restriction piece 61 and a second restriction piece 62 fixed to the inner wall of the lamp housing 1, and the first restriction piece 61 and the second restriction piece 62 are spaced apart to form an interlayer for mounting the light source plate 2. The first restriction piece 61 is located outside the second restriction piece 62. The second restriction piece 62 is provided with a plurality of openings 621 in the circumferential direction thereof, and an mounting portion 622 is provided between two adjacent openings 621, and an oblique angle 623 is provided on either end of the side of the mounting portion 622 adjacent to the first restriction piece (as shown in FIG. 11).

As shown in FIG. 10, the light source plate 2 includes a disk-shaped insulating plate 21, lamp beads 22 fixed onto the insulating plate 21, and the insulating plate 21 is a bakelite plate or a fiberglass plate. Thickness of the insulating plate 21 is equal to the interlayer pitch, and the side of the insulating plate 21 has a restriction portion 23 corresponding to the number of openings 621, and the restriction portion is smaller than the opening 621. The restriction portion 23 on the insulating plate 21 enters from the opening 621, and then the insulating plate 21 is rotated so that the restriction portion 23 is abutted against the mounting portion 622 and the first restriction piece 61, respectively, thereby preventing the insulating plate 21 from moving to be disengaged axially along the lamp housing 1.

Figure 11:
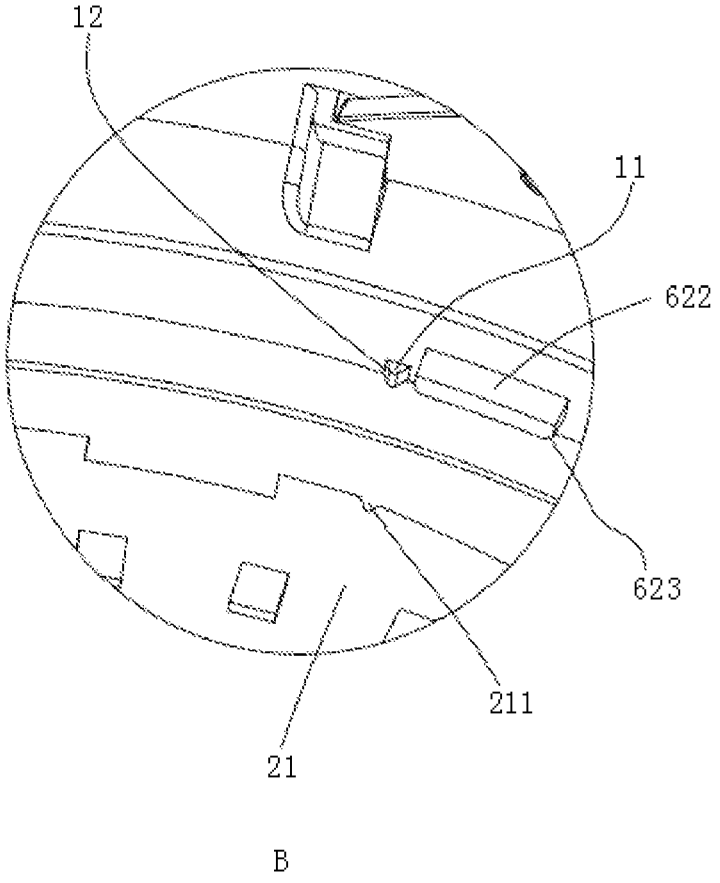
FIG. 11 is an enlarged view of the portion B of FIG. 10.

As shown in FIG. 11, a card 11 is fixed onto the inner wall of the lamp housing 1, and the card 11 is integrally molded with the lamp housing 1 by injection molding. The card 11 is provided with a guide slope 12 on either end in the direction of rotation along the insulating plate 21, which is V-shaped; a card slot 211 corresponding to the card 11 is provided on the side of the insulating plate 21.

As shown in FIG. 10, a guide notch 212 is provided on one side of the insulating plate 21 so as to clamp a card 11 into the card slot 211, the guide notch 212 is located on one side of the card slot 211 of the rotation trajectory of the insulating plate 21. The guide notch 211 is communicated with the card slot 211 and prevents the restriction portion 23 of the insulating plate 21 from interfering with the card 11 while entering from the opening 621.

As shown in FIG. 10, the insulating plate 21 is also fixed with a connection point 24 welded with the wire. In this embodiment, the connection point 24 is a welding point, that is, a wire is welded to the welding point on the insulating plate 21; when the insulating plate 21 is fixed, the welding point 24 has a distance difference with the outlet of the folded-over passage 55 in the trajectory extending circumferentially along the lamp housing 1.

As shown in FIG. 6, the second mount is an annular coupling slot 18 formed in the inner wall of the lamp housing 1. The lamp cover 3 is a transparent plastic circular piece having certain elasticity, and is clamped into the coupling slot 18 to be fixed.

As shown in FIG. 6, a plurality of heat dissipation holes 41 are formed on the protective cover 4, and the diameter of the heat dissipation hole 41 is smaller so that the general drippings cannot fall through the heat dissipation hole 41, and the protective cover 4 is connected to the lamp housing 1 by screws.

As shown in FIG. 7, two symmetrical metal connection pieces 71 are provided on the outside of the lamp housing 1 for mounting the LED lamp, and the metal connection piece 71 is a steel sheet. The metal connection piece 71 is inserted into the outer side of the lamp housing 1, and the inside of the lamp housing 1 is correspondingly inserted with a nut piece 72, and a bolt 73 passing through the metal connection piece 71 and the lamp housing 1, and screwed to the nut piece 72.

The restriction portion 23 on the insulating plate 21 enters from the opening 621 when mounted, and then the insulating plate 21 is rotated so that the restriction portion 23 is abutted against the mounting portion 622 and the first restriction piece 61, respectively, and the card 11 is clamped into the card slot 211 to mount the light source plate 2.

When the wire is mounted, the wire is first bent from the first passage 51 through the second passage 52 into the folded-over passage 55, and the guide is connected with the welding point 24 after coming from the outlet of the folded-over passage 55 to form a second bend, and the wire is S-shaped after being bent twice.

Then, the metal connection piece 71 is attached to the lamp housing 1 to clamp the lamp cover 3 into the annular card slot 13, and finally mounting the protective cover 4.

In order to rationally make use of the space, the drive power can be mounted into the protective cover 4, which is not shown in the present embodiment.

The LED lamps can also be in form of project lamps and floodlamps.

The invention claimed is:

1. An LED lamp, comprising a lamp housing, a lamp cover and a light source plate, the lamp cover is located at one end of the lamp housing, and the other end of the lamp housing is provided with an opening, the light source plate comprises an insulating plate and lamp beads provided on the insulating plate; and the insulating plate is connected with the lamp housing, and the insulating plate encloses the opening;

wherein a first restriction piece and a second restriction piece are provided in an inner wall of the lamp housing, the first restriction piece and the second restriction piece are spaced apart, the second restriction piece is provided thereon with an opening, a side of the insulating plate is fixed thereon with a restriction portion that is smaller or equal to the opening, the restriction portion is abutted against the first restriction piece and the second restriction piece respectively after the restriction portion of the light source plate is brought into rotation from the opening.

2. The LED lamp according to claim 1, characterized in that the insulating plate is a bakelite plate or a fiberglass plate.

3. The LED lamp according to claim 1, characterized in that the insulating plate is covered with a copper layer on one side far from the lamp beads.

4. The LED lamp according to claim 1, characterized in that a first card slot and a second card slot are provided in the lamp housing, the insulating plate is clamped with the first card slot, and the lamp cover is connected to the second card slot.

5. The LED lamp according to claim 1, characterized in that the lamp housing is further provided thereon with a protective cover located at the other end of the light source plate, and the protective cover is provided thereon with a heat dissipation hole.

6. The LED lamp according to claim 1, characterized in that a card slot is provided on the light source plate, and the inner wall of the lamp housing is provided thereon with a card in cooperation with the card slot.

7. The LED lamp according to claim 1, characterized in that the light source plate further comprises a connection point fixed onto the insulating plate, and a wire connected to the connection point and passing out of the lamp housing; the lamp housing is provided thereon with a mounting hole for the wire entering the inner cavity of the lamp housing, and the wire is bent at least twice during entering from the mounting hole to the path connected with the connection point.

8. The LED lamp according to claim 7, characterized in that the mounting hole comprises a first passage extending circumferentially along the lamp housing, a second passage axially extending along the lamp housing to be communicated therewith, and a folded-over passage communicated with the second passage and extending circumferentially along the lamp housing; the first passage, the second passage and the folded-over passage are connected successively, and the folded-over passage is opposite to the extending direction of the first passage; an outlet and the connection point of the folded-over passage are spaced in the circumferential direction of the lamp housing.

9. The LED lamp according to claim 1, characterized by further comprising a mounting assembly for mounting the LED lamp, the mounting assembly comprises a metal connection piece inserted outside the lamp housing, a nut piece inserted inside the lamp housing, and a bolt passing through the metal connection piece and the lamp housing and screwed to the nut piece.

* * * * *